United States Patent [19]

McDonald

[11] Patent Number: 4,487,598

[45] Date of Patent: Dec. 11, 1984

[54] BAG FOLDING APPARATUS

[75] Inventor: James A. McDonald, Palos Heights, Ill.

[73] Assignee: Union Carbide Corporation, Danbury, Conn.

[21] Appl. No.: 61,455

[22] Filed: Jul. 27, 1979

Related U.S. Application Data

[63] Continuation of Ser. No. 891,822, Mar. 30, 1978, abandoned.

[51] Int. Cl.[3] ..... B65H 45/18

[52] U.S. Cl. ..... 493/450; 493/463

[58] Field of Search ..... 270/62, 66, 69, 67, 270/80–85; 93/84 R, 84 FF, 1 G

[56] References Cited

U.S. PATENT DOCUMENTS

| | | | |
|---|---|---|---|
| 3,252,700 | 5/1966 | Henry | 270/69 |
| 3,611,882 | 10/1971 | Anderson | 93/84 R |
| 3,671,033 | 6/1972 | Coast | 270/83 |
| 3,773,315 | 11/1973 | Tsien | 270/69 |
| 3,790,157 | 2/1974 | Crawford | 270/83 |
| 3,917,254 | 11/1975 | Watrous | 270/86 |
| 3,918,698 | 11/1975 | Coast | 270/69 |

*Primary Examiner*—A. J. Heinz

*Attorney, Agent, or Firm*—John C. Lefever; Real J. Grandmaison

[57] ABSTRACT

An apparatus for use in connection with folding bags made from a flimsy material such as plastic, includes a feeding system for discharging bags along a feed direction with each bag having a plurality of corrugated regions in the transverse direction with respect to the feed direction; a receiving system for receiving the bags from the feeding system and for maintaining in each bag at least some of the corrugated regions until each of the bags stops its movement along the feed direction, and a fence near the receiving system for stopping the movement of each of the bags along the feed direction.

4 Claims, 7 Drawing Figures

FIG. 4
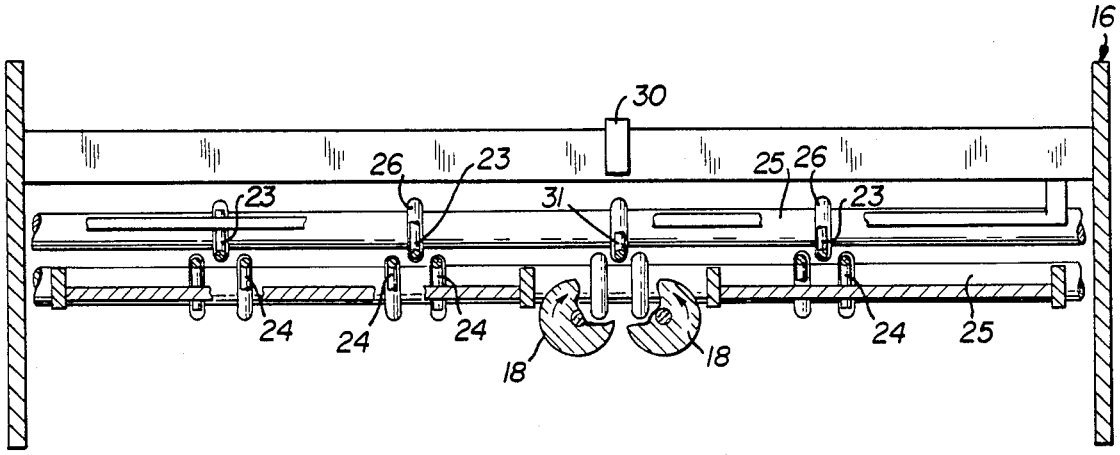
FIG. 5
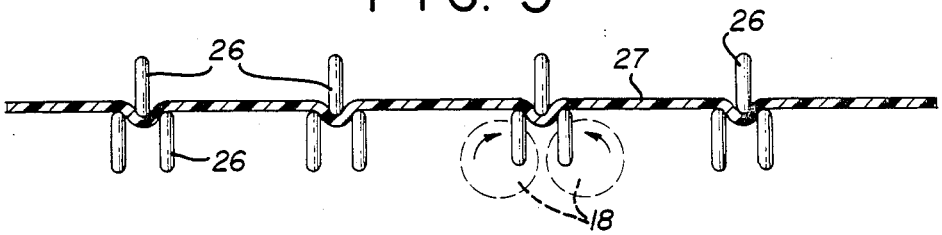
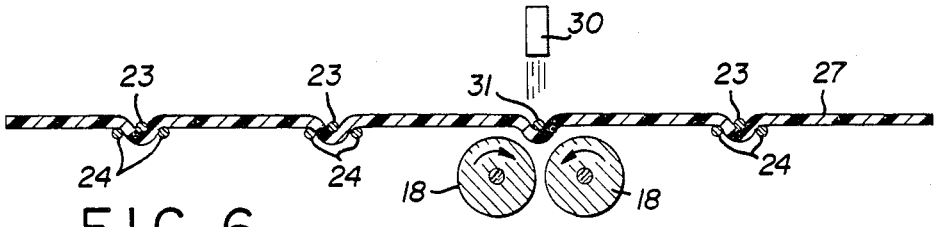
FIG. 6
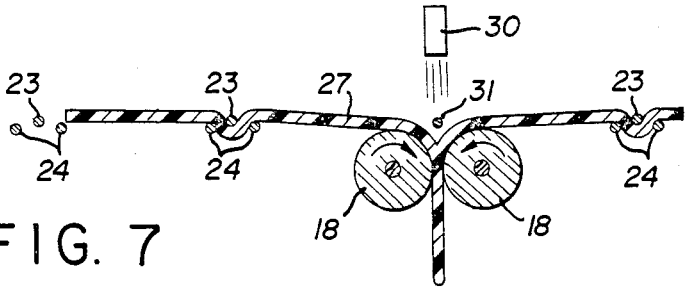
FIG. 7

BAG FOLDING APPARATUS

This application is a continuation of our prior U.S. application Ser. No. 891,822 filed Mar. 30, 1978, now abandoned.

The present invention relates to a bag folding and packaging machine, and particularly to an apparatus for use in connection with folding bags made from a flimsy material such as plastic.

The use of bags made of plastic material has found wide acceptance and a large commercial market has been developed. The physical differences between flimsy bags such as bags made from plastic and bags made from paper or cellulosic products has required the development of new machinery and equipment in order to produce plastic bags economically.

Generally, plastic bags can be made of film forming polymers such as polyethylene, polypropylene, and polyvinylchloride and the like and can be multilayered In comparison to the paper or cellulosic counterparts the plastic bags have substantially poor structural rigidity, are thinner, and have much lower surface friction characteristics.

Generally, the manufacturing of plastic bags starts with plastic film which is formed into separate bags and these bags are then folded and packed into boxes which will eventually be puchased by the consumers.

In a typical production system, the plastic bag is formed and then discharged into a receiving region from which the final folding operation proceeds. Each bag is discharged into the receiving region in a flat state and slides into the region until a barrier generally referred to as a fence prevents further sliding of the bag. When the bag comes to rest, it must be in substantial alignment with the fence.

It has been found that the poor alignment of the plastic bag in the receiving region can interfere with subsequent operations and thereby reduce production efficiency. Poor alignment tends to occur for the plastic bag in a prior art apparatus frequently because the leading edge of the bag which is to be stopped by the fence has poor structural rigidity so that the leading edge can some times be distorted. Another cause of poor alignment is that the bags are delivered to the receiving system such that the leading edge is not square with the feed direction. The retained corrugations stiffen the leading edge of the bag thereby allowing it to square up when it strikes the fence.

Generally, this problem of poor alignment can occur if a bag is discharged with corrugated regions if the dimensions of the bag in the feed direction is relatively large. It has been found that even a large plastic bag which has been folded one time before being discharged with corrugated regions can become misaligned because of the poor retention of the corrugated regions during the movement of the bag into the receiving region.

It is a goal of the present invention to overcome this problem and thereby improve the production efficiency and economy for bags made of flimsy material such as plastic.

It is to be understood that the invention is not intended to be limited to bags and that the invention can also be used in connection with sheets of flimsy material and the like.

One of the principal objects of the invention is an apparatus for use in connection with folding bags made from a flimsy material, comprising feeding means operable for discharging successive bags in a feed direction with each bag having a plurality of corrugated regions having grooves in the feed direction and having undulations in the transverse direction, receiving means operable for receiving the bags from the feeding means and operable for maintaining in each of the bags at least some of the corrugated regions at least until each of the bags stops its movement along the feed direction, and a fence near the receiving means for stopping the movement for each of the bags along the feed direction.

Another object of the invention is the apparatus for use in connection with folding bags wherein the feeding means comprising a set of shafts and a plurality of spaced tires mounted on the shafts in cooperation with each other to provide the plurality of corrugated regions in each bag and to move each bag in the feed direction.

A further object of the invention is the apparatus for use in connection with folding bags wherein the receiving means comprises a plurality of upper rods and a plurality of lower rods and the rods cooperate with each other in order to maintain in each of the bags at least some of the corrugated regions at least until each of the bags stops its movement along the feed direction.

Further objects and advantages of the invention will be set forth, in part, in the following specification and, in part, will be obvious therefrom without being specifically referred to, the same being realized and attained as pointed out in the claims hereof.

The invention accordingly comprises the features of construction, combination of elements and arrangement of parts which will be exemplified in a construction hereinafter set forth and the scope of the application of which will be indicated in the claims.

For a fuller understanding of the nature and objects of the invention, reference should be had to the following detailed description, taken in conjunction with the accompanying drawings, in which:

FIG. 4 is a cross-sectional view of the invention along sectional line 4—4 of FIG. 2;

FIG. 5 is a cross-sectional view of the invention along sectional line 5—5 of FIG. 2 with portions removed and illustrates a plastic bag being corrugated;

FIG. 6 is the same cross-sectional view as FIG. 4 with additional portions removed and illustrates a plastic bag in the initial stages of being transferred for subsequent folding and packaging; and FIG. 7 is the same as FIG. 6 but shows the plastic bag in a subsequent position of being transferred.

In carrying the invention into effect, an embodiment has been selected for illustration in the accompanying drawings and for description in the specification, reference being had to FIGS. 1 to 7.

Figure 1:
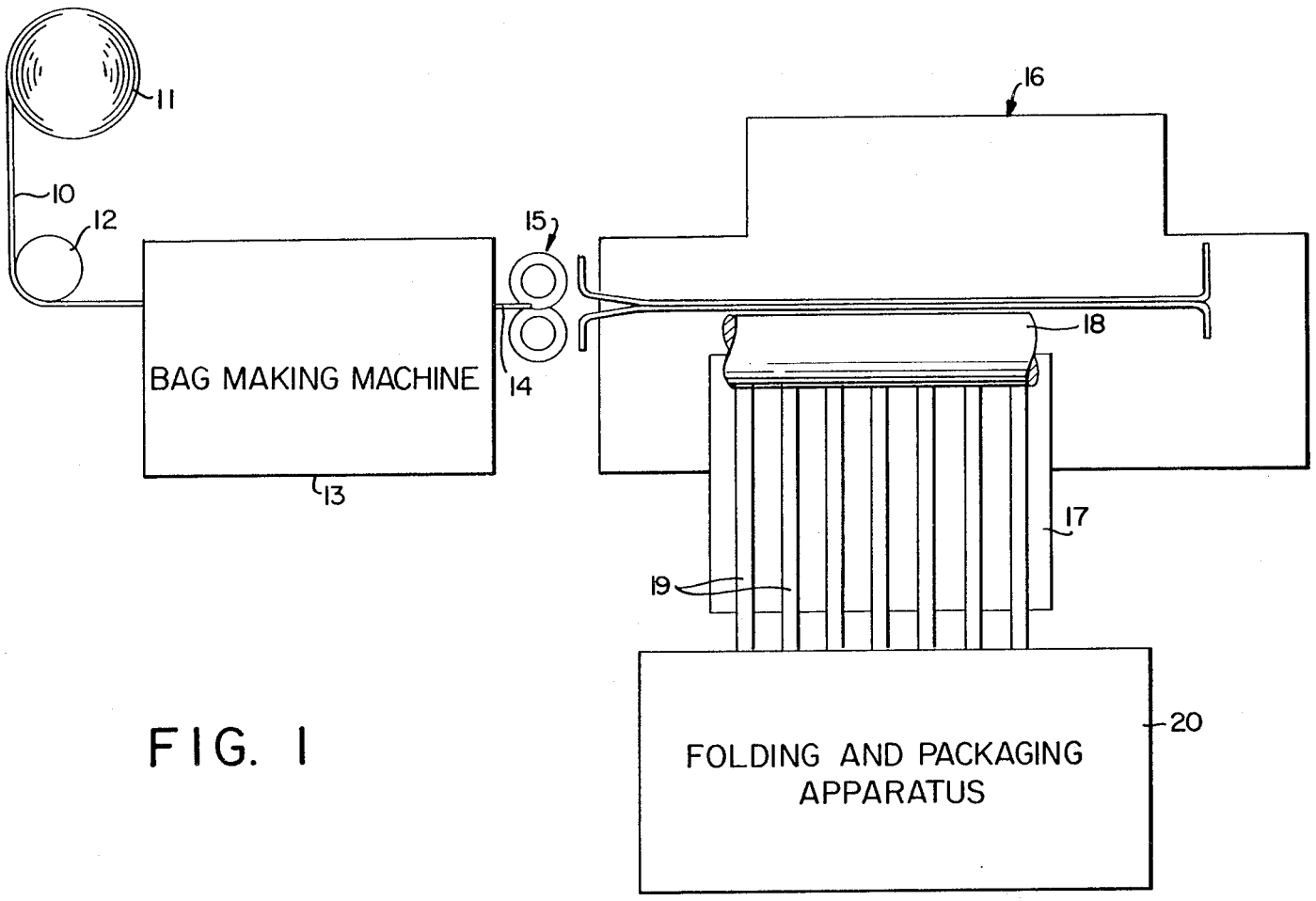
FIG. 1 shows the present invention in relationship to a bag making machine and a folding and packaging apparatus.

FIG. 1 shows a complete system for producing folded and packaged bags from a roll of plastic film. For the embodiment shown, plastic film 10 in the form of a roll 11 is moved around roller 12 into a bag making machine 13. The plastic film 10 on the roll is prefolded longitudinally.

It is to be understood that the plastic film 10 could be supplied from an extruder and thereafter prefolded prior to entering the bag making machine 13. The plastic film 10 can also be supplied from other known ways such as from a roll without the film having a fold and prefolding the film prior to its entering the bag making machine 13.

Typically, the bag making machine 13 can be a Model 208 Polyethylene Bag Making Machine manufactured by G. T. Schjeldahl Company in combination with a Model Accu-Folder Folding Machine manufactured by FMC Corporation.

The machine 13 produces a bag 14. The bag 14 is longitudinally folded with the crease being the leading edge. The crease, however, is usually not well defined due to the characteristics of the film. The bag 14 moves through feeding means such as corrugating roller 15 into a receiving means 16. The bag 14 comes to rest in the receiving means 16 in a generally flat condition and thereafter is removed from below such as shown by bag 17 by nip rollers 18 in combination with belts 19 for additional processing and packaging by apparatus 20.

Figure 2:
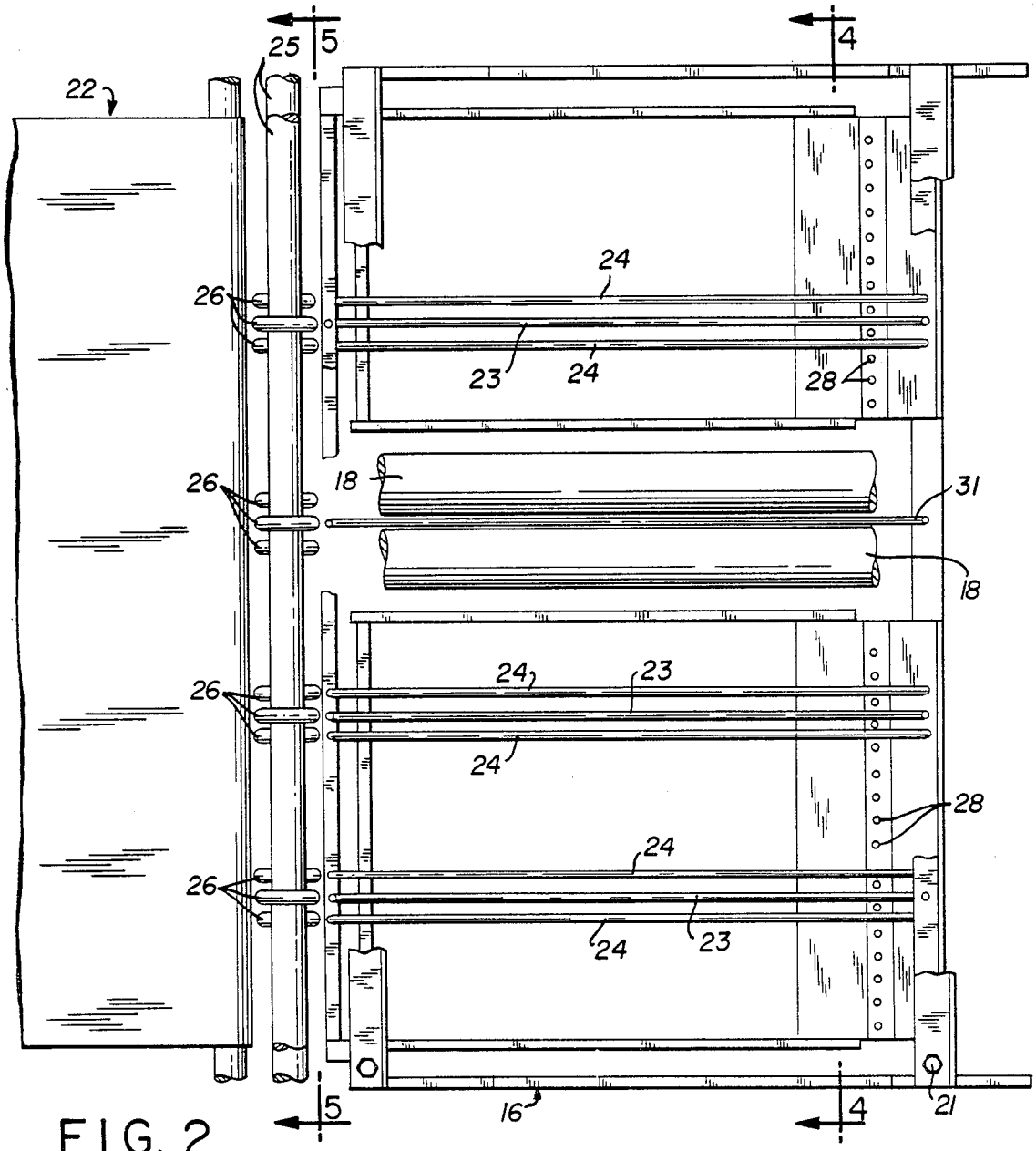
FIG. 2 is a plan view of the present invention with portions removed.
Figure 3:
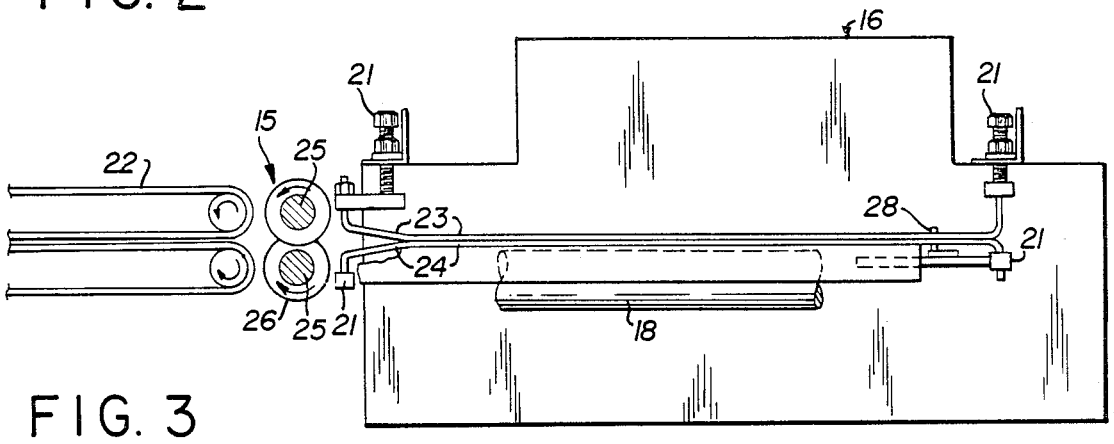
FIG. 3 is a partial side elevational view of the present invention with portions removed.

From FIGS. 2 and 3, it can be seen that bags can be moved by conveying system 22 to corrugating rollers 15 into a plurality of upper rods 23 and a plurality of lower rods 24. An adjusting system 21 allows the groups of rods to be moved vertically to obtain a predetermined spacing at a predetermined height. Each rod position within its group is adjustable. Each of the corrugating rollers 15 comprises a drive shaft 25 and tires 26.

Generally each of the tires 26 is an annular ring of an elastic material and each tire 26 frictionally engages the shaft 25. The material can be a plastic such as polyurethane or a rubber-like material or the like. The tires 26 are grouped in clusters and serve to grip and remove bags from the conveying system 22 when the corrugating rollers 15 are driven. Each group of tires 26 forms a corrugated region in a bag passing between the corrugating rollers 15.

As used herein, a corrugated region is a physical variation as shown in FIG. 5 which shows four corrugated regions.

The corrugated regions provide good structural rigidity to the bag so that when the leading edge contacts the barrier, the bag resists deformations which would tend to misalign the bag. The corrugated regions improve the rigidity of the leading edge as well as the rigidity of the overall body of the bag so that the bag misalignment is corrected when it strikes the fence.

From FIGS. 2 and 3, it is evident that the invention is not directed to a system requiring bags to be stacked in the receiving region.

The interaction between a bag 27 and the tires 26 can be seen by reference to FIGS. 4 and 5. The relationship between the rods 23 and 24 with respect to the tires 26 can be seen by reference to FIG. 4.

Generally, the end portions of the upper rods 23 near the corrugating rollers 15 are positioned to extend to approximately the lower extremities of the tires 26 on the upper rod 25. Similarly, the end portions of the lower rods 24 near the corrugating rollers 15 are positioned to be near the upper extremities of the tires 26 on the lower rod 25.

FIG. 6 shows a plastic bag after it has come to rest after sliding between the rods 23 and 24 to a barrier such as fence 28. The fence 28 is a linear arrangement of fixed vertical cylinders as shown in FIGS. 2 and 3.

The bag 27 is moved towards pinch roller 18 by an air knife means 30. Generally, an air knife is a linear arrangement of air nozzles which provide a blast of air for moving a plastic bag towards pinch rollers. A typical air knife is described in the U.S. Pat. No. 3,918,698 to Coast.

For a bag removal system using an overhead air knife and pinch rollers, it is preferable to define a corrugation in the bag to correspond to the space between the pinch rollers and generally to extend towards the pinch rollers. As shown in FIG. 6, it is preferable to have a rod 31 above the bag 27 and tending to deform the bag 27 towards the rollers 18.

FIG. 7 shows the plastic bag 27 after it has been engaged by nip rollers 18 and is being pulled downward between belts 19.

I wish it to be understood that I do not desire to be limited to the exact details of construction shown and described, for obvious modifications will occur to a person skilled in the art.

Having thus described the invention, what I claim as new and desire to be secured by Letters Patent, is as follows:

1. An apparatus for providing bags made from a flimsy material in an aligned configuration with a receiving means for final folding and packaging operations, comprising:

supplying means operable for supplying bags each of which has a single fold;

feeding means operatively coupled to said supplying means and operable for discharging successive single folded bags in free motion in a feed direction with the folded edge of each bag being the leading edge and with each discharged bag having a plurality of corrugated regions comprising grooves aligned in said feed direction and undulations along the transverse direction;

receiving means operable for receiving said bags from said feeding means and operable for maintaining in each of said bags at least some of said corrugated regions at least until each of said bags stops its movement along said feed direction;

wherein said receiving means comprises a plurality of upper rods and a plurality of lower rods, said rods being positioned generally along said feed direction and with respect to at least some of said corrugated regions to maintain said corrugated regions at least during the movement of each of said bags; and a fence near said receiving means for stopping the movement of each of said bags along said feed direction.

2. The apparatus as claimed in claim 1, wherein said receiving means further comprises an adjusting means operable for changing the position of said plurality of upper rods and said plurality of lower rods.

3. The apparatus as claimed in claim 2, wherein each of said bags comes to rest above a set of nip rollers and below an air knife means operable for forcing a stream of air against a generally imaginary straight line along said bag to move said bag towards said nip rollers.

4. The apparatus as claimed in claim 1, wherein said fence is positioned to provide a barrier to the movement of each of said bags whereby each of said bags comes to rest in a predetermined position.

* * * * *